US008430032B2

(12) United States Patent
Farizy et al.

(10) Patent No.: US 8,430,032 B2
(45) Date of Patent: Apr. 30, 2013

(54) AVALANCHE TRIGGERING SYSTEM

(75) Inventors: Bruno Farizy, Saint Jean de la Porte (FR); Louis Noel, Cusy (FR); Stephane Constant, Saint Pierre d'Allevard (FR); Jean-Marc Neuville, Sassenage (FR); Pascal Roux, Le Sappey en Chartreux (FR); Philippe Berthet-Rambaud, Chateauneuf (FR)

(73) Assignee: Technologie Alpine de Securite-Tas (FR)

( * ) Notice: Subject to any disclaimer, the term of this patent is extended or adjusted under 35 U.S.C. 154(b) by 29 days.

(21) Appl. No.: 12/747,045

(22) PCT Filed: Dec. 9, 2008

(86) PCT No.: PCT/FR2008/052254

§ 371 (c)(1),
(2), (4) Date: Sep. 3, 2010

(87) PCT Pub. No.: WO2009/080977

PCT Pub. Date: Jul. 2, 2009

(65) Prior Publication Data

US 2011/0139029 A1 Jun. 16, 2011

(30) Foreign Application Priority Data

Dec. 14, 2007 (FR) ..... 07 08734

(51) Int. Cl.
*F42D 3/00* (2006.01)

(52) U.S. Cl.
USPC ..... 102/363; 102/302

(58) Field of Classification Search ..... 102/301, 102/302, 305, 363, 293; 89/1.11, 1.14, 1.1
See application file for complete search history.

(56) References Cited

U.S. PATENT DOCUMENTS

| | | | | |
|---|---|---|---|---|
| 5,107,765 | A | 4/1992 | Schippers | |
| 6,279,481 | B1 * | 8/2001 | Schippers | 102/302 |
| 6,374,717 | B1 * | 4/2002 | Schippers | 89/7 |
| 7,707,938 | B2 * | 5/2010 | Hisel | 102/302 |
| 2006/0254449 | A1 | 11/2006 | Hisel | |
| 2011/0005423 | A1 * | 1/2011 | Greipl | 102/363 |

FOREIGN PATENT DOCUMENTS

| | | | |
|---|---|---|---|
| FR | 2636729 | A1 | 3/1990 |
| FR | 2897931 | A1 | 8/2007 |

OTHER PUBLICATIONS

International Search Report PCT/FR2008/052254; Dated Jul. 20, 2009.

* cited by examiner

*Primary Examiner* — James Bergin
(74) *Attorney, Agent, or Firm* — Cantor Colburn LLP

(57) ABSTRACT

The invention relates to an avalanche triggering device comprising at least one enclosure (4) for confining an explosive gas mixture, having a downward-facing opening and being equipped with gas supply means (15, 16) designed to at least partly fill the volume defined by the enclosure (4) with the explosive gas mixture at a density less than that of the air, the device also comprising means (14) for igniting this mixture; which device is characterized in that the enclosure (4) is in the general shape of a bell or frustoconical shape with an approximately vertical axis.

19 Claims, 6 Drawing Sheets

AVALANCHE TRIGGERING SYSTEM

TECHNICAL FIELD

The invention concerns a device for triggering an avalanche and notably a snow avalanche.

Such a device is notably used for the protection of sites such as transport infrastructures, ski areas or inhabited areas, in particular after significant snowfall, by triggering an avalanche as a preventive measure.

BACKGROUND

Numerous techniques exist to deliberately trigger avalanches.

A first technique consists in the positioning of an explosive charge by an operator in the slope where the triggering of an avalanche is required. The positioning of the explosive in the slope may be performed in accordance with two methods, namely throwing it from the ground or a helicopter, and sliding the charges. With regard to the charge initiation, this is classically performed using a slow fuse or electrically.

This first technique presents a certain number of risks for the powdermen. Specifically, their interventions necessarily take place during periods of considerably unstable snow accumulation and in dangerous areas. They are therefore exposed to the risk of an avalanche, not only during preparation and realization of the blast, but also during their movements to and from the firing station, in other words, the place for preparing the blast and for igniting the charge. These risks are the main cause of accidents during triggering operations. In the case of using a helicopter, the risks inherent to transporting and initiating explosives in an aircraft must be added, all the more in often delicate aerological conditions.

Remote triggering techniques have been implemented in order to prevent the powdermen from moving in the firing zone. The objective is to move the firing station away from the firing point, in other words, from the position of the charge at the moment it explodes.

A remote triggering device is known under the name of CATEX. This is a conveyor cable mounted on a fixed infrastructure, enabling an explosive to be brought into a predetermined firing zone that is accessible by the conveyor cable.

Such a solution, although reducing the risks for the operator, only allows avalanches to be triggered in zones served by the cable. Moreover, such a technological solution involves the transport and storage of explosives, which calls for stringent safety criteria to be met. Finally, the installation of a long-distance conveyor cable remains very expensive.

Another device is known under the name of GAZEX. This is described in document FR 2 636 729. It comprises a gun with a closed base having an open frontal mouth directed towards the snow accumulation. Moreover, it comprises an oxidizing gas supply circuit and a fuel gas supply circuit, the two gases coming from two distinct sources. The nozzles for filling the gun with these gases are arranged on various zones of the gun and an ignition device is mounted at the rear of the latter. The explosive gas mixture, composed for example of propane and oxygen, is formed in the gun, the explosion being caused by the ignition device. More specifically, the gun takes the general shape of a neck, the explosive gas mixture having a greater density to air and thus accumulating in the lower section of the gun without escaping through the open frontal mouth.

This device, although having proved its effectiveness, must be mounted in a fixed manner in the zone at risk. Consequently, it cannot be transported easily, which requires the mounting of a device on each firing zone.

U.S. Pat. No. 4,873,928 describes a device to generate a shock wave through the explosion of an explosive gas contained in a balloon. The device comprises an expandable balloon, a device for filling the balloon with an explosive mixture of oxygen and hydrogen, and an ignition device designed to trigger the explosion.

Document EP 1 031 008 describes a similar device in which the balloon is simply fixed to a support, the end facing downwards, such that during inflation, the balloon is directed upwards.

A large part of the shock wave generated by the explosion of the balloon is lost and is not transmitted to the snow accumulation, due to the orientation of the explosion.

Such a device does not therefore produce optimum results. Specifically, as the balloon is fixed to a support and facing upwards, the majority of the explosion is directed upwards and laterally since the support acts as an obstacle for the movement of the wave between the balloon and the snow accumulation. In the same manner as previously, this remote triggering device cannot be transported.

Other remote triggering techniques use military weapons. In this way, rocket launchers or mine launchers are used, mainly in Switzerland, or recoilless guns or the LoCAT shell launcher are used in the United States of America.

However, some legislation, and in particular legislation in France, prohibits the storage of primed charges, which renders the use of such devices impossible.

In order to remedy these disadvantages, document WO 2007/096524 proposes a transportable avalanche triggering device, the explosion of which is mainly directed towards the snow accumulation and requiring no transportation or storage of explosives, and whose use conforms with the various national legislations.

It comprises a frame fitted with means of attachment for transporting the device, especially by helicopter with the aid of a cable, the frame comprising, at the top, a storage area for at least one gas container designed to form an explosive mixture and, at the bottom, a device for holding a plurality of elastic balloons, each having an inflation end oriented upwards, the body of each balloon extending in the opposite direction and the balloons being separated from each other. Furthermore, this device comprises means for conveying the explosive mixture to the inflation end of a balloon, an injection nozzle, means for igniting the explosive mixture, means for successively bringing the injection nozzle and the ignition means to the inflation end of each balloon.

Such a device can be transported over various firing zones above the snow accumulation in order to cause an avalanche by the explosion of a balloon located at the bottom of the device. The majority of the explosion is thus towards the snow accumulation.

In addition, such a device does not require the transportation of explosives, as the explosive mixture is created on the site before firing, which, in fact, enables a safe distance to be respected.

Furthermore, as this device is fitted with several balloons, it is possible to perform a series of explosions, which enables either guaranteeing the triggering of an avalanche by repeating a first firing without effect, or triggering several avalanches in different areas, without having to recharge the device.

However, such a device presents the following disadvantages.

The casing that enables the mixture to be contained until the explosion may pose inflation problems or premature explosion.

In addition, such devices, despite using several balloons, require the system to be recharged frequently.

The mechanical systems necessary for the device to function are, furthermore, potentially fragile or the source of problems in certain conditions of use (cold, frost, etc.)

BRIEF SUMMARY

The invention resolves these aforementioned disadvantages, by proposing a device for triggering an avalanche that is more reliable and has greater autonomy.

To this end, the device for triggering an avalanche comprises at least one containment of an explosive gas mixture presenting an opening facing downwards, fitted with gas supply means, designed to fill, at least partly, the volume defined by the containment with the explosive gas mixture with a lower density to that of air, the device comprising, furthermore, means for igniting this mixture, characterized in that the containment takes the general shape of a bell or is tapered along the substantially vertical axis.

Thus, during operation, the containment is progressively filled with the explosive gas mixture, which has a tendency to accumulate at the top of the containment, due to its density being less than that of air. The explosion is then created using ignition means and the expansion of the gases due to the explosion causes a shock wave, the latter being mainly directed downwards in the direction of the snow accumulation.

The reliability of such a device is increased by the fact that its operation does not require a complex mechanical system or a balloon designed to be inflated with the explosive gas mixture.

The shape of the containment as well as the density of the gas enable the gas to be confined in the containment for a period of time and in relatively significant proportions, enough to create the explosion in good conditions and with a significant effect on the snow accumulation.

According to a characteristic of the invention, the volume of the containment is between 0.5 and 10 $m^3$, preferentially of the order of 1 $m^3$.

Advantageously, the ignition means comprise at least one spark plug, preferentially two spark plugs, supplied by a high-voltage circuit.

According to one possibility of the invention, the ignition means are positioned on the side of the end of the containment opposite the opening.

Preferentially, the device comprises remote control means, for example radio control-type control means, designed to control the gas supply means and ignition means.

In an advantageous manner, the containment comprises, at one end opposite its opening, an end wall in the general shape of a dome.

The dome shape increases the resistance of the containment during the explosion.

According to a characteristic of the invention, the device comprises suspension means, for example from a helicopter, or means of mounting to a fixed structure.

According to a form of execution, the containment comprises a reduced section in order to define, from top to bottom, a converging zone and a diverging zone, which increase the speed of gas ejection.

The increase in speed of gas ejection enables the impact of the explosion on the snow accumulation to be increased.

According to one possibility of the invention, the supply means comprise at least one injection nozzle positioned on the side of the end of the containment opposite the opening and facing this end.

Preferentially, the gas supply means comprise means for storing an oxidizing gas, for example oxygen, and means for storing a combustible gas, for example hydrogen.

In this manner, the device according to the invention enables the transportation of two gases, which, when they are not mixed, do not have explosive properties, so that the risks related to transportation are reduced.

According to a characteristic of the invention, the gas supply means comprise a first circuit for supplying combustible gas and a second circuit, distinct from the first, for supplying oxidizing gas, opening in a distinct manner into the containment, the mixture of the two gases being created in the volume defined by the containment so as to form an explosive gas mixture.

The separate supply of the two gases enables the supply circuit to be simplified by avoiding the creation of a distinct mixing chamber before entering the containment. According to an aforementioned characteristic, the mixing of gas is thus performed directly in the volume of the containment. Moreover, this independence of supply circuits enables the desired gas mixture to be generated, preferably close to the stoichiometry, depending notably on the firing characteristics to be obtained.

Advantageously, the means for storing the combustible gas and the means for storing the oxidizing gas are respectively related to a first and second injection nozzle through the intermediary of a first and second supply line, each comprising, from upstream to downstream, at least one pressure regulator, at least one solenoid valve and at least one non-return valve.

Each supply line is therefore equipped with distinct control means, formed by solenoid valves. The pressure regulators may be set to a predetermined pressure, depending on the desired filling speed of the containment by the explosive gas mixture. The supply of gas at high pressure enables the device filling time to be reduced before the explosion. The non-return valve prevents any possible flashback in the corresponding line.

According to one possibility of the invention, at least one of the supply lines comprises two pressure regulators.

The use of two pressure regulators better controls the injection pressure of the corresponding gas in the containment volume.

In an advantageous manner, at least one of the supply lines, preferentially the first supply line, intended for combustible gas such as hydrogen, comprises two solenoid valves.

The presence of two solenoid valves increases the safety of the device.

According to a characteristic of the invention, at least one of the supply lines comprises at least one calibrated orifice positioned between the pressure regulator and the corresponding solenoid valve.

Advantageously, the device comprises a pressure sensor designed to detect the pressure of the means for storing at least one gas.

According to one possibility of the invention, the supply means are designed to be able to control the supply of the containment with oxidizing gas alone, in order to saturate the containment with oxidizing gas.

In this manner, the containment may be filled with a non-explosive gas mixture, saturated with oxidizing gas, for example oxygen, in order to render safe or neutralize the device when the containment has been filled and the procedure is interrupted before the explosion.

Preferentially, the means for storing gas comprise a plurality of bottles mounted in a regular manner distributed along the periphery of the containment.

In an advantageous manner, the device comprises measuring means designed to determine the distance between the device and the ground.

An operator can thus position the device at an appropriate distance from the ground in order to increase the effectiveness of the firing.

A preferential distance is of the order of 1 to 8 meters. It is possible to control the means for controlling the explosion ignition with this device for measuring the distance of the containment in relation to the ground, so that ignition is only facilitated when the containment is at a distance from the ground within a determined interval.

According to a variant of the embodiment, the device comprises at least one mobile flap between a first position in which the opening of the containment is blocked by the flap, at least partly, and a second position in which the flap is moved away from the opening of the containment.

The flap enables the discharge of the explosive gas mixture to be limited outside the containment. The presence of such a flap obviously remains optional, given that the shape of the containment itself guarantees such a confinement function.

In any case, the invention will be understood correctly using the following description, with reference to the attached schematic drawing representing, as a non-limiting example, several forms of execution of this device for triggering an avalanche.

DETAILED DESCRIPTION

Figure 1:
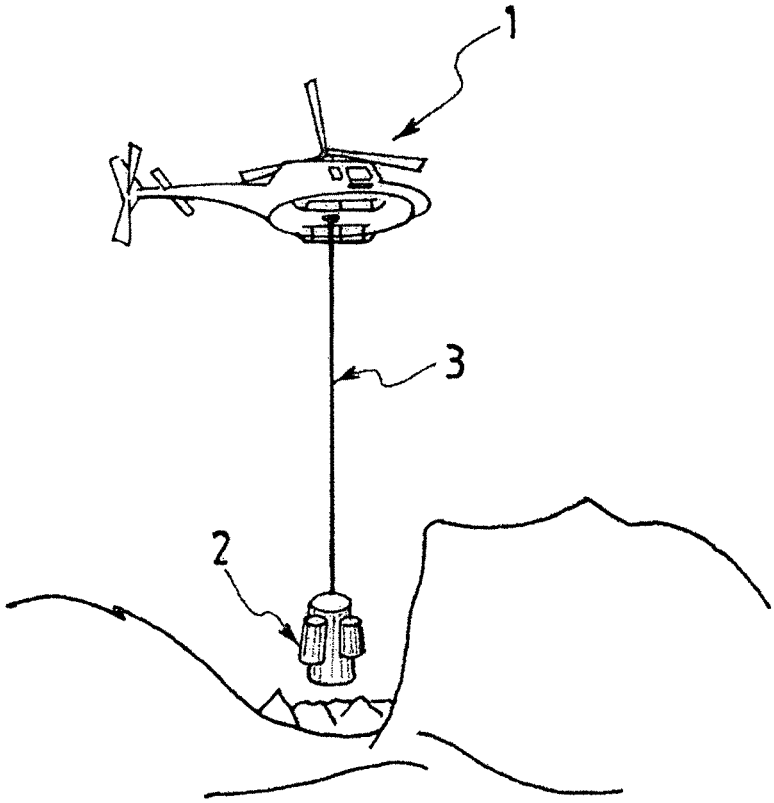
FIG. 1 is a view of a helicopter equipped with a device according to the invention.

FIG. 1 represents a helicopter 1 connected to a device for triggering an avalanche 2 according to the invention through the intermediary of a sling 3.

Figure 3:
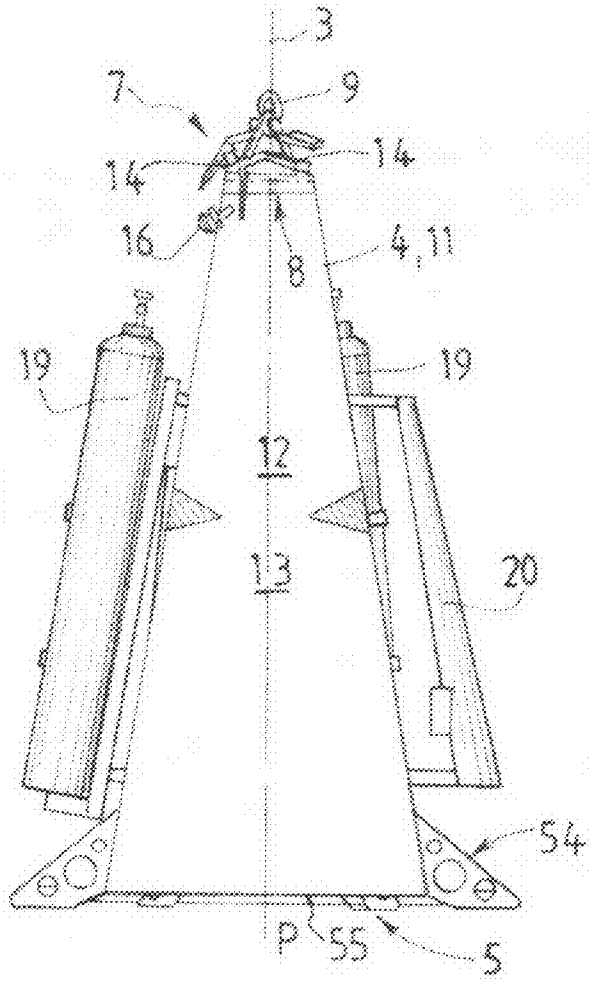
FIG. 3 is a longitudinal section view on an enlarged scale of a containment of this device.
Figure 2:
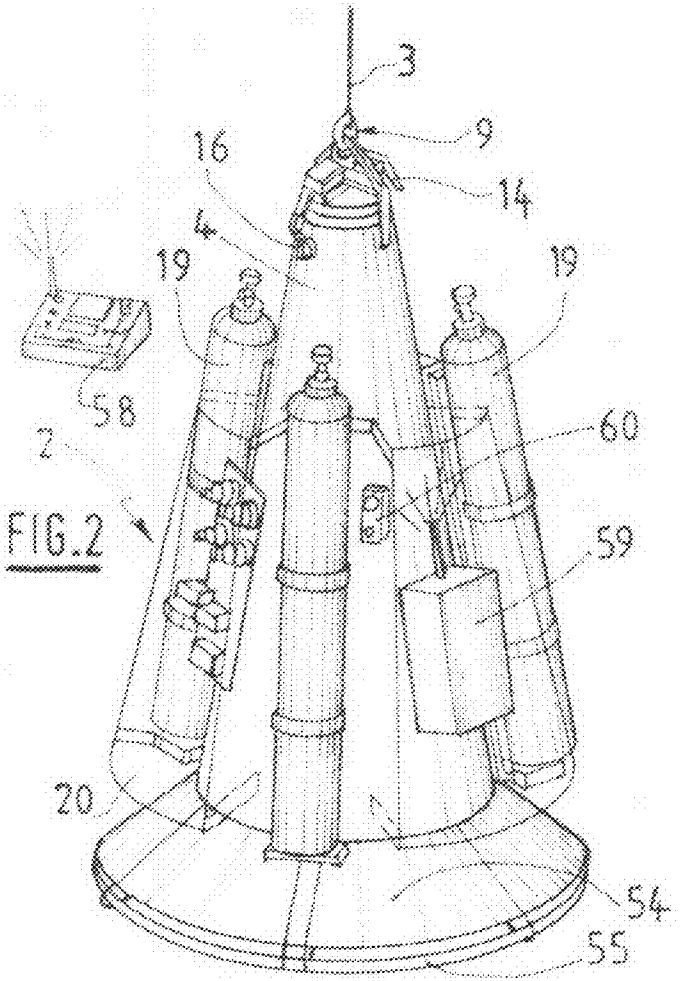
FIG. 2 is a perspective frontal view of a first form of embodiment of this device.
Figure 4:
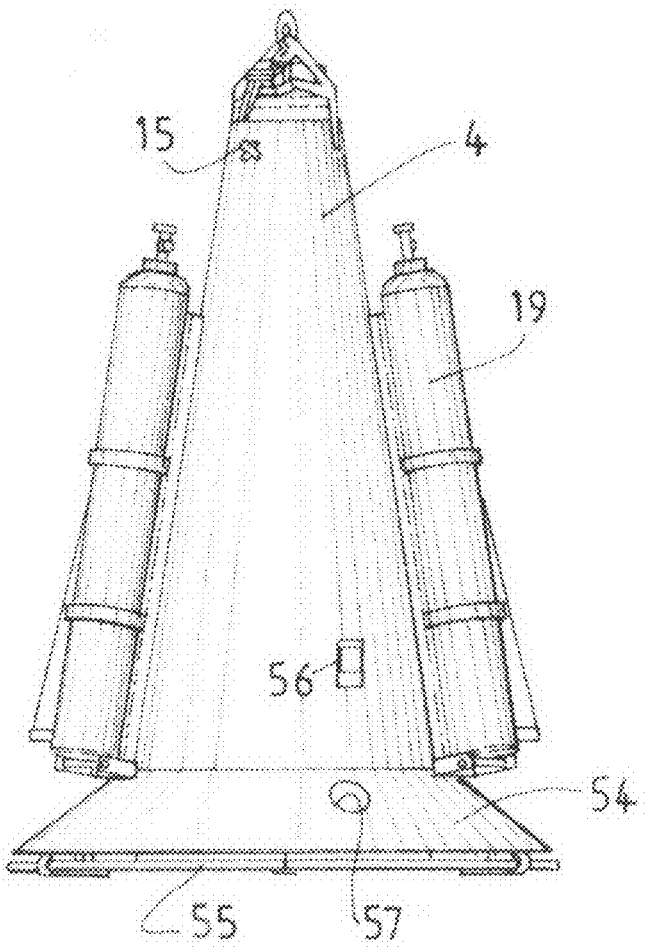
FIG. 4 is a perspective view of the rear.

A first form of embodiment of this device is represented in FIGS. 2 to 4.

In this form of embodiment, the device 2 comprises a containment 4 for confining an explosive gas mixture in a generally tapered form and made of steel, comprising at least a first end 5 facing downwards, in other words, in the direction of the snow accumulation, with an opening 6 and a second end 7 opposite the first, comprising an end wall 8 that is convex or in the general shape of a dome.

The wall 8 is equipped with means of attachment 9 connected to the sling 3 and is fixed, such that it may or may not be able to move, to the tapered wall 11 of the containment 4.

As is better represented in FIG. 3, the containment 4 also comprises a reduced section in order to define, from top to bottom, a converging zone 12 and a diverging zone 13, which enables the speed of gas ejection to be increased.

The containment 4 has an internal volume between 0.5 and 10 $m^3$, preferentially of the order of 1 $m^3$.

The containment 4 is furthermore equipped with two supply nozzles 15, 16, positioned on the side of the closed end 7 of the containment 4 and facing upwards, in other words, in the direction of the wall 8. The supply nozzles 15, 16 are positioned symmetrically in relation to the longitudinal median plane P of the containment 4.

The containment 4 is furthermore equipped with two spark plugs 14 positioned at the level of the wall 8, symmetrically in relation to the longitudinal median plane P of the containment, and capable of providing a spark inside the latter. The spark plugs 14 are each supplied by a high-voltage circuit, which is not represented.

As is apparent in FIG. 2, the device comprises three bottles 17, 18, 19, each containing 50 L and having a pressure of 200 bars. The bottles are distributed regularly and fixed to the external wall of the containment 4 by an appropriate support. In addition, each bottle 17, 18, 19 is connected, at its upper zone, to the containment 4 by a retaining cable designed to maintain the bottle in the event of the rupture of the aforementioned mounting elements and/or a mounting error by an operator. These cables are oversized so as to be able to retain the ejection of bottles in the event of an accident.

A first and second bottle contain hydrogen, a third bottle contains oxygen. Covers 20 span the containment zones located between the bottles and are fixed to the containment. The covers 20 are intended to protect the electrical or pneumatic equipment and to improve the aerodynamics of the assembly.

A protective skirt 54 is furthermore positioned at the level of the open end 5 of the containment 4. The skirt 54 is tapered and opens out downwards. This skirt 54 prevents the gas contained in the containment from being aspirated to the exterior by winds created by the helicopter 1. The free end of the skirt oriented downwards is equipped with a protective arch 55.

Furthermore, the device is equipped with measuring means designed to determine the distance between the device and the ground. The measuring means comprise a laser range finder 56 (see FIG. 4), positioned on the external wall of the containment 4 and located opposite an opening 57 housed in the skirt 54 and enabling measurements to be taken. It should be noted that the covers 20 have not been represented in FIG. 4 for reasons of drawing legibility.

Figure 5:
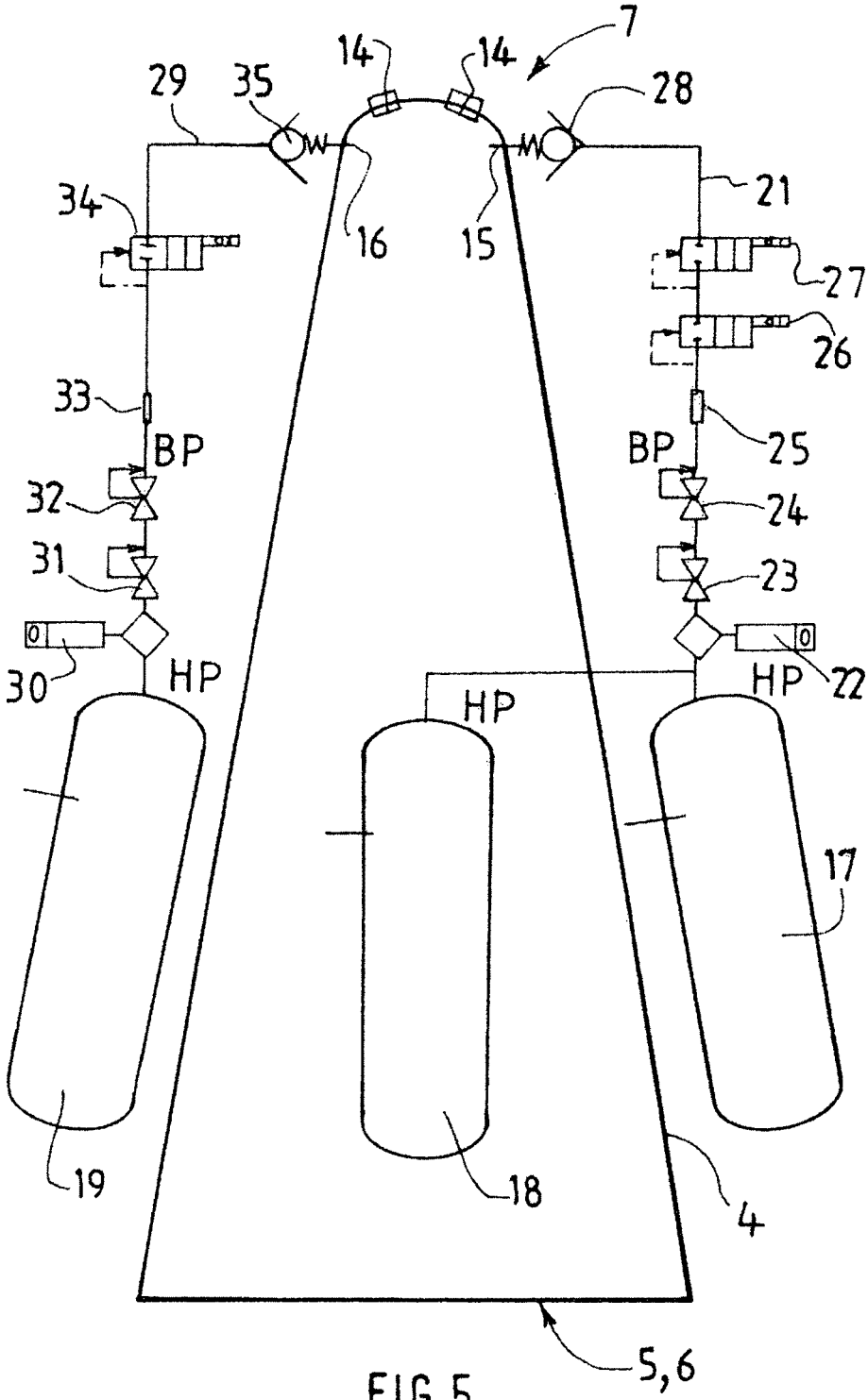
FIG. 5 is a schematic representation of the supply means of this device.

As is represented in FIG. 5, a first injection nozzle 15 is connected to the hydrogen bottles 17, 18 by a first supply line 21 comprising, from upstream to downstream, in other words, bottles 17, 18 towards the first injection nozzle 15, a pressure sensor 22, a first pressure regulator 23, a second pressure regulator 24, a calibrated orifice 25, a first solenoid valve 26, a second solenoid valve 27 and a non-return valve 28.

The bottles 17, 18 are joined in parallel and are connected to the corresponding line 21 by a high-pressure flexible bracket equipped with an anti-whip cable.

A second injection nozzle 16 is connected to the oxygen bottle 19 by a supply line 29 comprising, from upstream to downstream, in other words, from the bottle to the second injection nozzle, a pressure sensor 30, a first pressure regulator 31, a second pressure regulator 32, a calibrated orifice 33, a solenoid valve 34 and a non-return valve 35.

For each line 21, 29, the solenoid valves 26, 27, 34 are closed in a rest position and are located as close as possible to the pressure regulators 24, 32.

The use of two pressure regulators and the passing through a calibrated orifice enables the supply flow to be controlled and enables the proportions of hydrogen and oxygen injected in the containment 4 to be checked, as the mixture of these gases is close to stoichiometry regardless of the pressure in the corresponding bottle(s). The pressure regulators 23, 24, 31, 32 are preset. More specifically, the pressure regulators are set to a suitable pressure to ensure that the containment 4 is filled within the shortest time possible, preferentially of the order of 7 seconds.

The non-return valves 28, 35 are stainless-steel disc valves and prevent potential flashback in the lines 21, 29. The non-return valves 28, 35 are positioned as close as possible to the nozzles 15, 16 located on the containment 4.

All of the lines 21, 29 are made from flame-resistant material.

The spark plugs 14 and solenoid valves 26, 27, 34 are controlled in a radio control manner automatically by an operator located remotely. More specifically, the operator uses a remote control or a radio control console 58, cooperating with reception means housed in a unit 59 mounted on the containment 4. Additional control means 60 are mounted directly on the containment 4.

The pressure sensors 22, 30 detect the status of the oxygen and hydrogen reserves; the control means are capable of converting this information into a visual signal for the operator.

The functioning of the device will now be described in more detail.

During a firing sequence, the helicopter first positions the device for triggering an avalanche 2 in the desired zone, at a predetermined distance from the ground, using the measuring means.

The operator, equipped with a remote control with two buttons in order to avoid the risk of accidental triggering, simultaneously presses and holds down the two buttons.

The control means then open the solenoid valves 26, 27, 34 in order to fill the containment 4 and therefore mix the gas. The density of the explosive gas mixture is less than that of air, which has a tendency to rise in the direction of the closed end 7 of the containment. The volume of explosive gas mixture supplied during filling is less than the volume of the containment. This prevents the explosive gas mixture from overflowing when filling the containment 4.

Ignition of the gas by the spark plugs 14 automatically follows the filling stage and is controlled by the control means without intervention from the operator. This is therefore a semi-automatic firing procedure.

The control means are also designed to accept potential micro-breaks in the signal, for example due to a momentary loss of radio waves, without affecting the firing procedure.

If at least one of the buttons is released before firing, this causes a reflex stop action in case of a potential problem, the control means automatically suspend the firing procedure in progress while continuously displaying a visible warning message for the operator. In this case, and within a time limit of 30 seconds, the next time the operator simultaneously presses and holds down both buttons, the interrupted firing procedure is automatically terminated, in other words, the control means start filling again, then cause ignition.

At the same time, the control means present an additional safety control, which, if the operator wishes to discharge the explosive gas mixture in the container, starts to fill the containment with oxygen only, and for a period of the order of 30 seconds, so that saturation of the containment 4 with oxygen is guaranteed, then burns the residual combustible gas in the containment by automatic ignition of the spark plugs 14.

In the case where the pressure sensor 30 associated with the oxygen bottle 19 detects an oxygen reserve that is too low to be able to perform the aforementioned safety procedure, the control means prevent any new firing.

Furthermore, in the event of an incomplete firing procedure, the control means prompt safety measures of the containment of the aforementioned type by a warning device.

Figure 7:
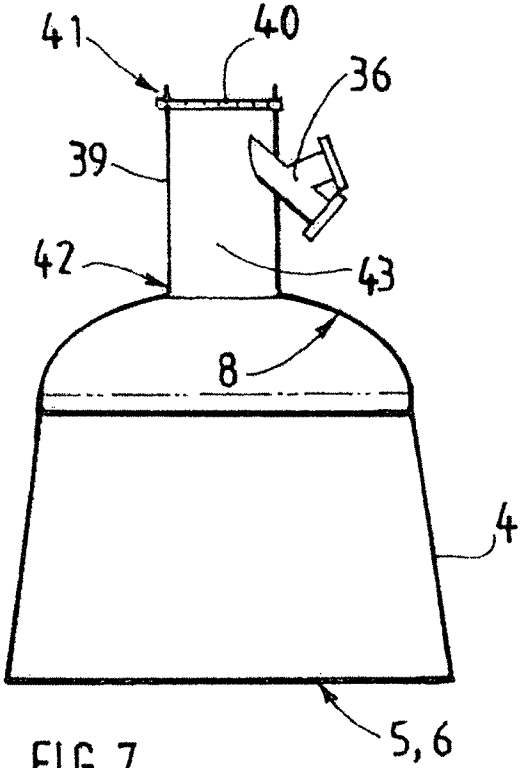
FIGS. 6 and 7 are views corresponding to FIG. 3, respectively of a second and third form of embodiment of a containment.
Figure 6:
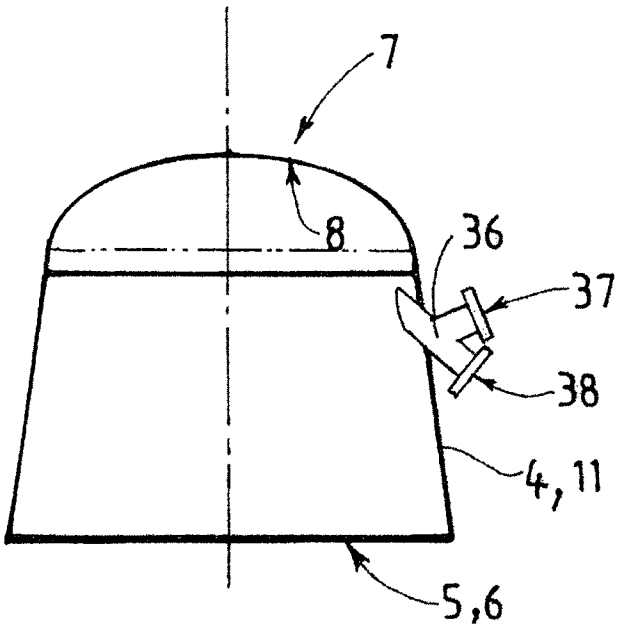
Figure 8:
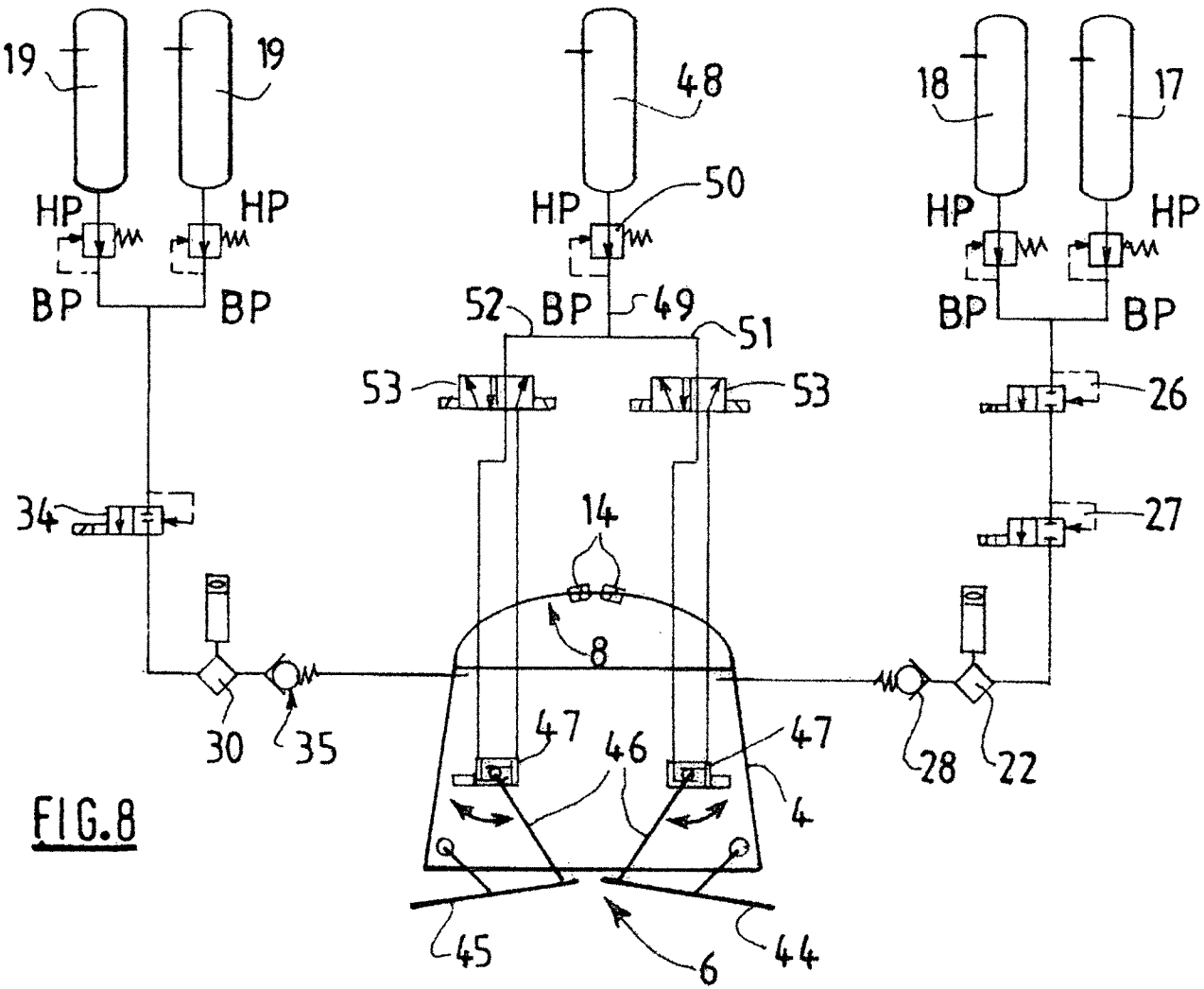
FIG. 8 is a schematic view of the entire device with a containment as represented in FIG. 6.

Other forms of embodiment are represented in FIGS. 6 to 8. The references used previously are re-used to identify the elements with the same functions.

In the form of embodiment represented in FIG. 6, the containment 4 takes the general form of a bell delimiting an internal volume of the order of 1 $m^3$. More specifically, the containment comprises a tapered wall 11 and an end wall 8. The containment is supplied at one single point through a coupling 36 with two branches 37, 38, to which the oxygen and hydrogen supply lines 21, 29 are connected.

According to another form of embodiment represented in FIG. 7, the containment 4 is surmounted with a tubular element 39 having an end wall 40 at one end 41 and the other end 42 opening into the containment. The two-branch coupling 36 is connected to the tubular element 39, the latter being equipped with spark plugs 14 (not represented on this figure).

The tubular element 39 creates a chamber 43, located upstream of the containment 4, in which gas injection and ignition are realized. Such a chamber 43 limits the amount of turbulence generated by filling and limits the potential overflows by injecting a reduced volume. Furthermore, this allows the explosive gas mixture, which is lighter than air, to be better contained, close to the spark plugs 14, while being less sensitive to exterior turbulence as this chamber is farther from the opening 6 of the containment 4.

According to another form of embodiment of the invention, the containment is equipped with mobile flaps 44, 45, which aim to block, at least partially, the opening 6 of the containment 4 during the filling phase. This variant of embodiment is represented in FIG. 8 in combination with a containment 4 of the type exposed in FIG. 6, but can be applied to any type of containment.

As represented in FIG. 8, the containment 4 is equipped with a first and second flap 44, 45 arranged symmetrically in relation to the longitudinal median plane of the containment, the flaps being articulated on arms 46. The movement of each flap 44, 45 is activated by a single-acting type rotary actuator 47, supplied by inert gas, for example argon. More specifically, a bottle of inert gas 48 containing 20 L at 200 bars is connected to a supply line 49 equipped with a pressure gauge 50 downstream from which extend the first and second supply lines 51, 52, respectively connected to each of the rotary actuators 47 by a control valve 53.

The control valves 53, and therefore the flaps 44, 45, are activated by the aforementioned control means, either during a semi-automatic sequence or independently by the operator.

The flaps 44, 45 are thus mobile between a first position in which they partially block the opening 6 of the containment 4 so as to limit explosive gas mixture leaking towards the exterior and a second position, in which they are moved away from the opening 6, so as not to disturb the gas ejected during the explosion.

It is self-evident that the invention does not limit itself to the only forms of execution of this system, described above by way of example, but it encompasses, on the contrary, all variants. It is thus notable that the containment could be suspended from a helicopter, but also from a vehicle equipped with a hoist or even secured to a fixed structure.

The invention claimed is:

1. A device for triggering an avalanche, comprising at least:

a containment with an opening facing downwards, a gas supply means designed to fill, at least partly, a volume delimited by the containment with an explosive gas mixture having a density less than that of air, a means for igniting the explosive gas mixture, wherein the containment extends along a substantially vertical axis, wherein the containment has a shape that tapers inwardly toward the vertical axis in a direction away from the opening, and wherein the means for igniting are positioned on a side of an end of the containment opposite from the opening.

2. The device according to claim 1, wherein the volume of the containment is between 0.5 and 10 $m^3$, preferentially of the order of 1 $m^3$.

3. The device according to claim 1, wherein the means for igniting comprise at least a spark plug, preferentially two spark plugs supplied by a high-voltage circuit.

4. The device according to claim 1, further comprising a remote control means, for example radio control-type control means, designed to control the gas supply means and the means for ignition.

5. The device according to claim 1, wherein the containment further comprises, at the end opposite its opening, an end wall in the general form of a dome.

6. The device according to claim 1, further comprising a suspension means, for example from a helicopter or a means of mounting to a fixed structure.

7. The device according to claim 1, wherein the containment comprises a reduced section so as to define, from top to bottom, a converging zone and a diverging zone, which increases the speed of gas ejection.

8. The device according to claim 1, wherein the supply means comprise at least an injection nozzle positioned on the side of the end of the containment opposite the opening and facing said end.

9. The device according to claim 1, wherein the gas supply means comprises a means for storing an oxidizing gas, for example oxygen, and a means for storing a combustible gas, for example hydrogen.

10. The device according to claim 9, wherein the gas supply means comprise a combustible gas supply circuit and another circuit, distinct from the combustible gas supply circuit, for supplying oxidizing gas, opening into the containment in a distinct manner, the mixing of the two gases being realized in the volume delimited by the containment so as to form the explosive gas mixture.

11. The device according to claim 10, wherein the means for storing combustible gas and the means for storing oxidizing gas are respectively connected to a first and a second injection nozzle through a first and a second supply line, each comprising, from upstream to downstream, at least a pressure regulator, at least a solenoid valve and at least a non-return valve.

12. The device according to claim 11, wherein at least one of the supply lines comprises two pressure regulators.

13. The device according to claim 11, wherein at least one of the supply lines, preferentially the first supply line, intended for combustible gas such as hydrogen, comprises two solenoid valves.

14. The device according to claim 11, wherein at least one of the supply lines comprises at least one calibrated orifice positioned between the pressure regulator and the corresponding solenoid valve.

15. The device according to claim 1, further comprising a pressure sensor designed to detect pressure in the means for storing at least one gas.

16. The device according to claim 9, wherein the gas storing means comprise a plurality of bottles mounted regularly and distributed around the periphery of the containment.

17. The device according to one of claims 10 and 15, wherein the supply means are designed to be able to control a supply of the containment with oxidizing gas alone, so as to saturate the containment with oxidizing gas.

18. The device according to claim 1, further comprising a measuring means designed to determine the distance between the device and the ground.

19. The device according to claim 1, further comprising at least a mobile flap between a first position in which the opening of the containment is blocked by the flap, at least partly, and a second position in which the flap is moved away from the opening of the containment.

* * * * *